US005607761A

United States Patent [19]

Christensen et al.

[11] Patent Number: 5,607,761

[45] Date of Patent: Mar. 4, 1997

[54] HIGH MODULUS REINFORCEMENT AND DIP-COAT PRODUCTION METHOD FOR SAME

[75] Inventors: Don C. Christensen, Bartlesville, Okla.; Milton F. Custer, Byron, Calif.

[73] Assignee: Hexcel Corporation, Pleasanton, Calif.

[21] Appl. No.: 418,199

[22] Filed: Apr. 7, 1995

Related U.S. Application Data

[63] Continuation-in-part of Ser. No. 289,897, Aug. 12, 1994, abandoned, which is a continuation-in-part of Ser. No. 6,504, Jan. 21, 1993, Pat. No. 5,380,576.

[51] Int. Cl.[6] ..... B32B 7/12

[52] U.S. Cl. ..... 428/366; 428/902; 428/369; 442/187; 442/229

[58] Field of Search ..... 428/35.7, 36.1, 428/36.3, 294, 902

[56] References Cited

U.S. PATENT DOCUMENTS

| | | | |
|---|---|---|---|
| 2,671,306 | 3/1954 | Slayter | 57/140 |
| 3,026,697 | 11/1962 | Novak | 156/178 |
| 3,147,582 | 9/1964 | Scharf | 57/165 |
| 3,591,434 | 7/1971 | Hartstern | 156/178 |
| 3,632,034 | 1/1972 | Kozak et al. | 228/4 |
| 3,687,776 | 8/1972 | Allard et al. | 156/306 |
| 3,919,028 | 11/1975 | Lewis et al. | 156/148 |
| 4,070,214 | 1/1978 | Brown et al. | 156/47 |
| 4,110,581 | 8/1978 | Prewo | 428/114 |
| 4,310,581 | 1/1982 | Felter et al. | 428/109 |
| 4,589,942 | 5/1986 | Korinek | 156/148 |
| 4,769,202 | 9/1988 | Eroskey et al. | 264/166 |
| 4,857,385 | 8/1989 | Armiger et al. | 428/189 |
| 4,868,035 | 9/1989 | Weinberg et al. | 428/212 |
| 4,975,232 | 12/1990 | Hattori et al. | 264/137 |
| 5,067,998 | 11/1991 | Singh et al. | 156/89 |
| 5,164,341 | 11/1992 | Chyung et al. | 428/902 X |
| 5,198,280 | 3/1993 | Harpell et al. | 428/109 |
| 5,208,090 | 5/1993 | Okitsu et al. | 428/113 |
| 5,277,957 | 1/1994 | Lopez et al. | 428/109 |
| 5,279,879 | 1/1994 | Takezawa et al. | 428/110 |
| 5,360,661 | 11/1994 | Muzzy | 428/902 X |
| 5,380,576 | 1/1995 | Christensen et al. | 428/109 |

*Primary Examiner*—Daniel Zirker
*Attorney, Agent, or Firm*—Poms, Smith, Lande & Rose

[57] ABSTRACT

A fiber protective coating system for storing, handling and protecting high modulus fibers is disclosed. An exemplary system includes a plurality of generally elongated and collimated fibers comprising a fiber bundle with fibers mutually bonded by one or more coatings of a resin and formed into a cylindrical configuration of twisted fibers for feeding directly to a loom in order to form a woven fabric.

5 Claims, 2 Drawing Sheets

HIGH MODULUS REINFORCEMENT AND DIP-COAT PRODUCTION METHOD FOR SAME

This application is a continuation-in-part of application, Ser. No. 08/289,897, filed Aug. 12, 1994, now abandoned which is a continuation-in-part of Ser. No. 08/006,504, filed Jan. 21, 1993, now U.S. Pat. No. 5,380,576.

BACKGROUND OF THE INVENTION

1. Field of the Invention

The present invention relates generally to high modulus fibers and methods for their handling and storage. More particularly, the present invention involves the design and production of a protective coating system for high modulus fibers used in manufacturing high strength woven fabric reinforcements.

2. Description of Related Art

During the past several years many researchers in the structural materials and sports equipment industries have focused on developing low density materials having increased strength and higher temperature resistance. For example, low weight structural materials having high stiffness and strength at temperatures in excess of 3,000° F. are in high demand for advanced aerospace applications. Similarly, low density, high impact resistant materials are continually in demand for fabricating racquets and related equipment used in sporting events.

In particular, continuous reinforced composite materials or ceramic matrix composites have enjoyed increased use as high temperature, high strength structural materials. These materials can be prepared by impregnating a woven fabric reinforcement, or prepreg, with a ceramic slurry, then subjecting the impregnated fabric to conventional lay-up procedures to form a molded lay-up. After heat treating or firing the molded lay-up, a relatively low density, high strength ceramic object forms which is useful in a number of high temperature structural applications.

Generally, the woven fabric reinforcement is formed of continuous fibers such as silicon carbide, alumina, mullite, graphite, or quartz, which are woven like a yarn in conventional weaving equipment to form the fabric. These materials can have a relatively high modulus, which makes them generally stiff, brittle, and prone to breaking when placed in a bent configuration. Fortunately, many of these high modulus materials can be drawn or made into such small diameter fibers or filaments that they can be bent and even tied into knots without breaking. Thus, fabric reinforcements formed of very fine diameter, high modulus continuous fibers can be handled and woven without breaking the fibers. Additionally, lay-up procedures can be performed using these woven fabrics without risking a decrease in the fabric's structural integrity due to fiber breakage.

More recently, materials technology has led to the development of boron, yttrium, yttrium aluminum garnet, and single crystal alumina (sapphire) and mullite continuous fibers. In particular, single crystal alumina fibers have remarkably high strengths and elevated temperature service properties, making them especially attractive for woven fabrics used for the manufacture of continuous fiber ceramic matrix composites. A major problem associated with handling sapphire fibers and producing viable continuous sapphire fiber woven fabrics is the limited fiber diameter available using fiber drawing procedures. Current production techniques for drawing single crystal alumina fibers are limited to drawing sapphire fibers having a minimum diameter of about 3 mils. Because the modulus of single crystal alumina is on the order of $51\times10^6$ psi, fibers having diameters of 3 mils are not capable of bending less than about a quarter-inch radius without breaking. This bending radius limitation dramatically affects the ability to handle sapphire fibers having lengths suitable for incorporating into continuous fiber fabrics. Thus, handling very high modulus fibers in conventional weaving equipment causes significant fiber breakage, resulting in poor quality and low strength fabrics.

One early approach to this sapphire fiber handling and weaving problem involved chopping continuous length fibers into smaller random lengths ranging from 1 inch to 3 inches and then converting the random lengths into a staple yarn. This technique proved to be unsuccessful because the stiff short sections were uncontrollable during the weaving process. In an attempt to overcome the problem with the staple yarn, the staple process was modified to include serving. This modification resulted in the ability to produce a yarn. However, the yarn had severely limited tensile strength.

In order to address the low tensile strength associated with the staple yarn and serving approach, this method was modified to incorporate a fugitive dacron carrier yarn during the staple yarn forming process and prior to serving. This modification did yield a weavable yarn. However, once the fugitive dacron carrier yarn and the fugitive serving yarn were removed from the woven fabric, subsequent handling caused the yarn to disintegrate and revert to individual fibers in a non-yarn form. This can occur, for example, during a ceramic matrix composite fabric impregnation step.

Still another approach to this handling problem is to develop processes for drawing single crystal alumina fibers having diameters on the order of less than 10 microns which can then be combined to form flexible multifilament weavable yarns. However, because of cost considerations and technical limitations, making small diameter filaments is not viewed as a viable production scale alternative.

Accordingly, it is an object of the present invention to provide processes and associated systems for handling continuous length high modulus fibers in order to reduce or eliminate fiber breakage during handling.

It is a further object of the present invention to provide materials and processes for protecting high modulus fibers during conventional weaving processes in which high strength woven fabrics are produced.

SUMMARY OF THE INVENTION

The present invention satisfies the above-described objectives by providing high modulus fiber protective coating systems and processes for handling and storing high modulus fibers in a manner which maintains their physical integrity. Advantageously, the high modulus fiber protective coating systems and associated processes of the present invention can be utilized to protect lengths of fibers during manufacturing processes which involve bending the fibers. The invention also provides the advantage of making a visible article from clear, transparent, nearly invisible fiber components. For this reason, the practice of the present invention is particularly useful in connection with storing and handling high modulus fibers for weaving applications. However, those skilled in the art will recognize that the systems and processes of the present invention are useful in any application in which enhancing the strength of combined fibers or filaments is of benefit.

More particularly, the present invention provides high modulus fiber protective coating systems which include a plurality of generally elongated and collimated fibers separated into bundles, in each of which the fibers are coated and bonded together to form a towpreg having a generally circular cross section.

In preferred applications intended for supporting and handling continuous fibers used in conventional weaving processes, a number of such fibers is drawn from a fiber growing unit and separated into a plurality of fiber bundles, each containing 1 to about 20 fibers, for example. An exemplary process includes first forming a plurality of collimated fiber bundles, each of the fiber bundles being formed of a plurality of collimated fibers that are tension controlled and pulled through the process. Each of the collimated fiber bundles is coated with, for example, a polymer resin.

Advantageously, the fiber protective coating system of the present invention is conveniently adapted to methods for handling protected fibers in processes involving their incorporation into a useable product. An exemplary handling process involves providing coated fibers in the form of a combined plurality of fiber bundles, separating individual fiber bundles from the combination by one or more combs or reeds, coating the bundles with a polymer, and feeding the individual fiber bundles to a means for forming each bundle into a circular cross-section configuration. The resulting cylindrically configured coated fiber bundles can then be utilized in selected processing equipment. Preferred processing equipment includes at least one weaving loom in which the formed coated fiber bundles function as yarns for the fabrication of woven fabrics.

Further objects, features, and advantages of the present invention will become apparent to those skilled in the art from a consideration of the following detailed description when considered in combination with the following drawings.

DETAILED DESCRIPTION OF AN EXEMPLARY EMBODIMENT

The present invention is based upon the discovery that fibers utilized in structural applications can be formed in bonded bundles and subsequently stored and processed while maintaining their physical integrity. This discovery has particular significance for processes involving handling high modulus fibers which tend to break upon even slight bending. In fact, the coated systems of the present invention will protect fibers having a modulus in excess of $65\times10^6$ psi and diameters of 3 mm.

The ability to protect high modulus fibers makes the systems and processes of the present invention useful for applications involving fibers such as single crystal alumina fibers which have a high modulus and minimum diameter limitations. In particular, the practice of the present invention allows continuous lengths of sapphire fibers to be formed into woven fabric utilizing conventional weaving equipment without significant fiber breakage. However, those skilled in the art will recognize that the teachings of the present invention are not limited to handling sapphire fibers or high modulus fibers in general. In fact the systems and process of the present invention are equally applicable for the safe handling of any type of fiber to assure proper protection and minimum breakage.

Since the fiber protective coating systems and associated processes of the present invention provide means for storing and handling fibers while avoiding significant fiber breakage, suitable fibers include, but are not limited to, those having a tendency to break as the result of even slight bending. These include fibers having such large diameters that normal handling causes them to break, as well as fibers having a modulus greater than about $30\times10^6$ at a fiber diameter of >15 mils. Such fibers include single crystal alumina, boron, yttrium, and yttrium aluminum garnet (YAG) fibers. Preferred fibers are drawn from single crystal alumina (sapphire).

Figure 1:
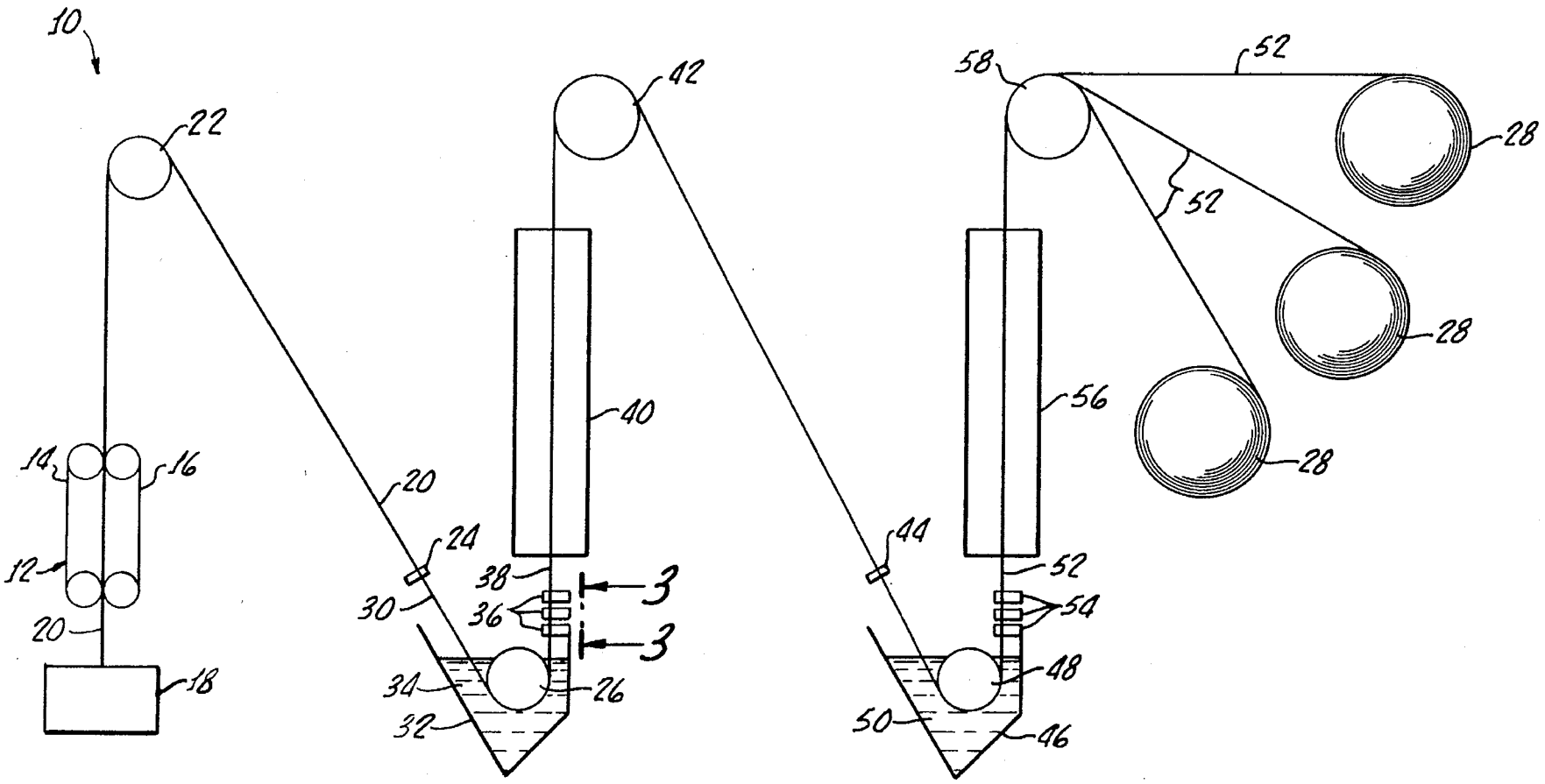
FIG. 1 is a pictorial diagram of a system illustrating the fiber protective coating principles of the present invention.

An exemplary system for forming fiber protective coating yarns for storage and subsequent handling in accordance with the present invention is illustrated in FIG. 1. As shown therein, the system 10 includes a means for forming a plurality of collimated fibers into a plurality of collimated fiber bundles, a means for bonding together the fibers of the bundles, and a means for forming the separated individual fiber bundles into cylindrical configurations for use as towpregs.

Figure 2:
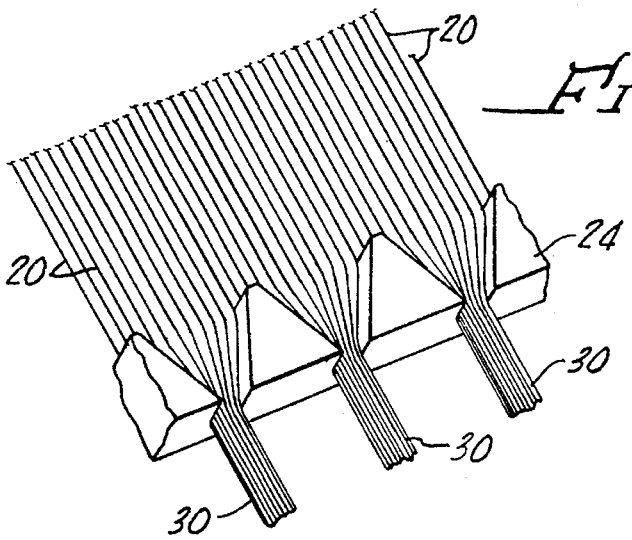
FIG. 2 is a fragmentary pictorial view of a representative comb element of FIG. 1 illustrating the separation of fibers into bundles.

More particularly, the system 10 includes a filament puller 12, consisting of a first endless belt 14 on one side and a second endless belt 16 opposing the first endless belt for providing collimated fibers 20 (shown in FIGS. 1, 2, and 3) from a fiber source 18. The collimated, co-planar fibers 20 are then passed around a first direction-changing roller 22, through a first comb or reed 24 and to a second directional roller 26. The fibers 20 are then separated by approximately one-eighth inch prior to passing through reed 24, and are pulled through the remainder of the process by individual towpreg winders 28. The winders 28 are constant torque so that filaments 20 are tension controlled throughout the process. Reed 24 is sized for grouping fibers 20 into a plurality of collimated, generally co-planar fiber bundles 30 as shown in FIG. 2.

At second directional roller 26, a first dip pan 32 containing a polymer 34 dissolved in a volatile solvent receives the aligned collimated fiber bundles 30, coating, bonding, and encapsulating the fibers 20 to one another within each bundle 30. Typical compounds used successfully for this fiber bonding in dip pan 32 are acrylic, polyester, polystyrene, or silicone resins.

Figure 3:
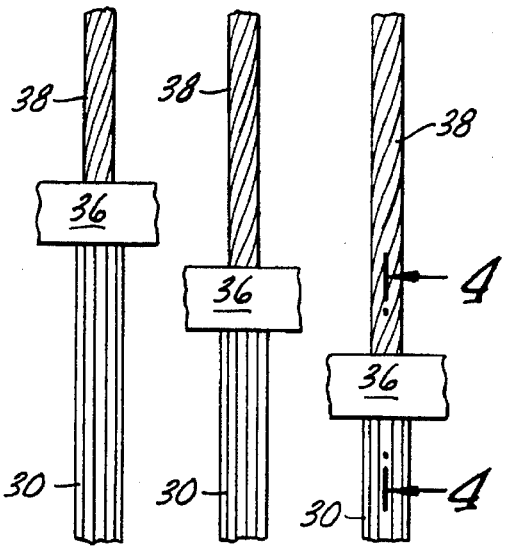
FIG. 3 is a cross section view of an orifice plate stack taken along line 3—3 of FIG. 1.
Figure 4:
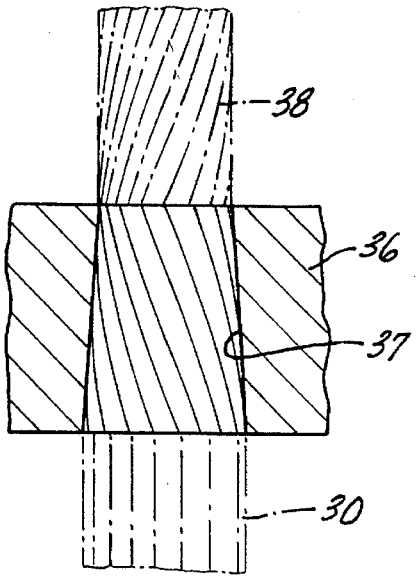
FIG. 4 is a cross section view of an individual orifice taken along line 4—4 of FIG. 3.
Figure 5:
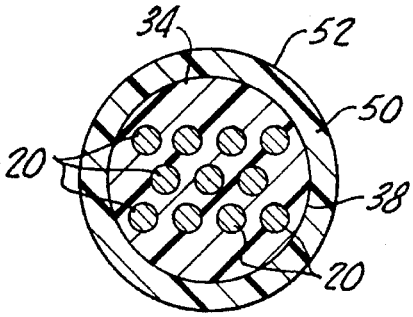
FIG. 5 is a cross-section view of a cylindrically configured coated fiber bundle of the present invention.

The bundles 30 are fed through a vertically staggered series of first orifice plates 36 which controls the amount of polymer 34 solution adhering to the fibers 20 and shapes the bundles 30 into intermediate towpregs 38. FIG. 3 illustrates the manner in which first orifice plates 36 are offset so that each plate 36 accommodates a portion of the now coated fibers 30. Typically, each first orifice plate 36 will contain approximately 55 orifices 37, shaped in the form of spiral funnels as more clearly seen in the cross section view of FIG. 4. As each bundle 30 advances through an orifice 37, excess polymer solution is drained from the bundle, and the fibers 20 are twisted with respect to one another by the spiral conformation of orifice 37 to further enhance the tensile strength of the bundles. The coated and twisted bundles are now intermediate towpregs and are designated by the numeral 38 in FIG. 1. Individual fibers in towpreg 38 are thus coated by a matrix of polymer 34 to form the circular cross-section configuration illustrated in FIG. 5.

An exemplary system may further include an oven 40 disposed between second directional roller 26 and a third direction-changing roller 42. The oven 40 would serve to evaporate the solvent from the polymer 34 solution that bonds the fibers on intermediate towpregs 38. It is possible, however, that at an anticipated system low operating speed of approximately 1.5 inches per minute, the solvent will evaporate at room temperature, rendering the oven 40 unnecessary.

Following polymer 34 bonding, the resulting intermediate towpregs 38 can be taken up on towpreg takeup rolls 28 or, alternatively, can be fed around third roller 42 to a second reed 44 which keeps the towpregs 38 separated, and then into a second dip pan 46 and around fourth roller 48 to produce finished towpregs 52. The solution in dip pan 46 may be identical to that in first dip pan 32, or of a different composition which functions as a release agent or lubricant to provide more desirable weaving characteristics. For example, a sizing resin 50 (such as polyvinyl alcohol or a silicone or perchloroethylene [FREKOTE 33H Releasing Interface available from Dexter Adhesives, Windsor Locks, Conn.]) may be selected for dip pan 46 to give a lubricated surface to the finished towpregs 52 that is slippery, non-tacky, and abrasion resistant.

Subsequently, second orifice plates 54 act to maintain the cylindrical configuration of finished towpregs 52, and oven 56 evaporates the solvent from the resin 50 solution if necessary. After changing direction via fifth roller 58, the doubly coated individual towpregs 52 (shown in cross section in FIG. 5) can be taken up on towpreg takeup rolls 28 for storage or used as yarn in a loom.

The formed individual towpregs 52 function as yarn during a weaving process. In applications where the woven fabrics produced in accordance with the present invention are incorporated into ceramic matrix composites, the woven fabric can be impregnated with ceramic according to processes known in the art.

Taken in combination with FIG. 1, the following example provides a non-limiting description of an exemplary process for providing coated high modulus fibers for feeding to conventional weaving equipment in processes for the fabrication of woven fabric reinforcement.

EXAMPLE 1

Twelve hundred sixty-five single crystal alumina (sapphire) fibers 20 having a diameter of 3 mils each were drawn from a filament-drawing crucible represented by numeral 18 in FIG. 1, and pulled from the crucible 18 by a caterpillar filament puller 12. The fibers were then controlled by caterpillar device 12 by driving the forward endless belt 14 at a slightly faster rate than the rear endless belt 16 to put very slight but uniform tension on each fiber to prevent buckling and subsequent fiber breakage as the fibers pass through the reed or comb 24 to a first dip pan 32 and around the directional roll 26. At comb 24, the 1265 fibers 20 were grouped into 115 bundles of 11 fibers each.

As the bundles 30 advanced through a fiber-bonding acrylic resin solution 34 within first dip pan 32, the fibers 20 in each bundle 30 became coated and thus bonded together by a matrix of acrylic resin 34. Each bundle 30 then passed through an orifice 37 by which excess acrylic resin 34 solution was removed and bundles 30 were twisted into the cylindrical form of intermediate towpregs 38. An oven 40 evaporated any remaining solvent from the acrylic resin 34 solution on the towpregs 38.

An additional coating step was performed at second dip pan 46, wherein intermediate towpregs 38 were coated with silicone solution 50 to produce finished towpregs 52. Each towpreg 52 was then wound on a take-up winder 28 for storage or fed into a weaving loom and woven into a high-strength sapphire woven fabric.

EXAMPLE 2

The procedure of Example 1 was followed except that only a single coating step was utilized. The binding resin used was SR 350 Silicone Resin available from General Electric Company, Silicones Division. The resin, which is a solid at room temperature, was heated to 160° F. to liquify it and solidified upon cooling, retaining the fibers in bonded fiber bundles.

Having thus described preferred exemplary embodiments of the present invention, it should be noted by those skilled in the art that the disclosure herein is exemplary only and that alternatives, adaptations, and modifications may be made within the scope of the present invention. Accordingly, the present invention is not to be limited to the specific embodiments illustrated herein.

We claim:

1. A fiber protective coated towpreg having improved high modulus fiber storage and handling characteristics comprising:

a plurality of elongated and collimated high modulus fibers selected from the group consisting of sapphire fibers, boron fibers, yttrium fibers, and yttrium aluminum garnet (YAG) fibers, comprising a coated fiber bundle, each of said fibers being coated with a polymer resin selected from the group consisting of acrylic, polyester, polystyrene, and silicone resins along its length and bonded to other of said fibers comprising said bundle, said coated fiber bundle being formed into a cylindrically configured fiber protective coated towpreg.

2. The towpreg of claim 1 wherein each said fiber has a thickness in the range of approximately one to five mils.

3. The towpreg of claim 1 wherein said coated bundle is advanced through an orifice having a spiral funnel configuration to produce a towpreg having spirally twisted fibers.

4. The towpreg of claim 1 wherein said towpreg is further coated with a release agent or lubricant to produce a multiply-coated finished towpreg.

5. The towpreg of claim 4 wherein said release agent or lubricant comprises a member selected from the group consisting of polyvinyl alcohol, silicone, and perchloroethylene.

* * * * *